US007638040B2

(12) United States Patent
Van Wees et al.

(10) Patent No.: US 7,638,040 B2
(45) Date of Patent: Dec. 29, 2009

(54) PROCESS FOR UPGRADING CONTAMINATED HYDROCARBONS

(75) Inventors: Mark Van Wees, Des Plaines, IL (US); Robert B. James, Jr., Northbrook, IL (US); Tom N. Kalnes, LaGrange, IL (US); Gavin P. Towler, Inverness, IL (US)

(73) Assignee: UOP LLC, Des Plaines, IL (US)

( * ) Notice: Subject to any disclaimer, the term of this patent is extended or adjusted under 35 U.S.C. 154(b) by 203 days.

(21) Appl. No.: 11/770,826

(22) Filed: Jun. 29, 2007

(65) Prior Publication Data

US 2009/0000985 A1 Jan. 1, 2009

(51) Int. Cl.
*C10G 11/20* (2006.01)

(52) U.S. Cl. ..... 208/177; 208/81; 208/82; 208/83; 208/84; 208/143; 208/144; 208/208 R; 208/209; 208/211; 208/212; 208/251 R; 208/251 H

(58) Field of Classification Search ..... 208/81–84, 208/179, 57, 97, 143–144, 208 R, 209, 211–212, 208/251 R, 251 H
See application file for complete search history.

(56) References Cited

U.S. PATENT DOCUMENTS 4,806,233 A 2/1989 James, Jr. et al. ..... 208/262.1
4,818,368 A 4/1989 Kalnes et al. ..... 208/50
4,840,721 A 6/1989 Kalnes et al. ..... 208/57
4,882,037 A 11/1989 Kalnes et al. ..... 208/85
4,923,590 A 5/1990 Kalnes et al. ..... 208/85
4,927,520 A 5/1990 Kalnes et al. ..... 208/50
5,176,816 A 1/1993 Lankton et al. ..... 208/85
5,224,565 A 7/1993 Tamura et al. ..... 208/92
5,302,282 A 4/1994 Kalnes et al. ..... 208/179
5,384,037 A 1/1995 Kalnes ..... 208/85
5,637,782 A 6/1997 Kalnes ..... 570/262
5,688,975 A 11/1997 Nair et al. ..... 549/531
5,876,591 A 3/1999 Lankton ..... 208/358
5,904,838 A 5/1999 Kalnes et al. ..... 208/179
5,969,201 A 10/1999 Kalnes et al. ..... 585/241
6,060,631 A 5/2000 James, Jr. et al. ..... 585/241

*Primary Examiner*—Robert J Hill, Jr.
*Assistant Examiner*—Brian McCaig
(74) *Attorney, Agent, or Firm*—Arthur E Gooding

(57) ABSTRACT

A process for the recovery and purification of a contaminated hydrocarbons, wherein the contamination includes metals, finely divided solids and non-distillable components. The process further includes hydroprocessing the oil to remove deleterious compounds, to produce high quality reusable lubricants, solvents and fuels and to improve the quality of water byproduct.

13 Claims, 1 Drawing Sheet

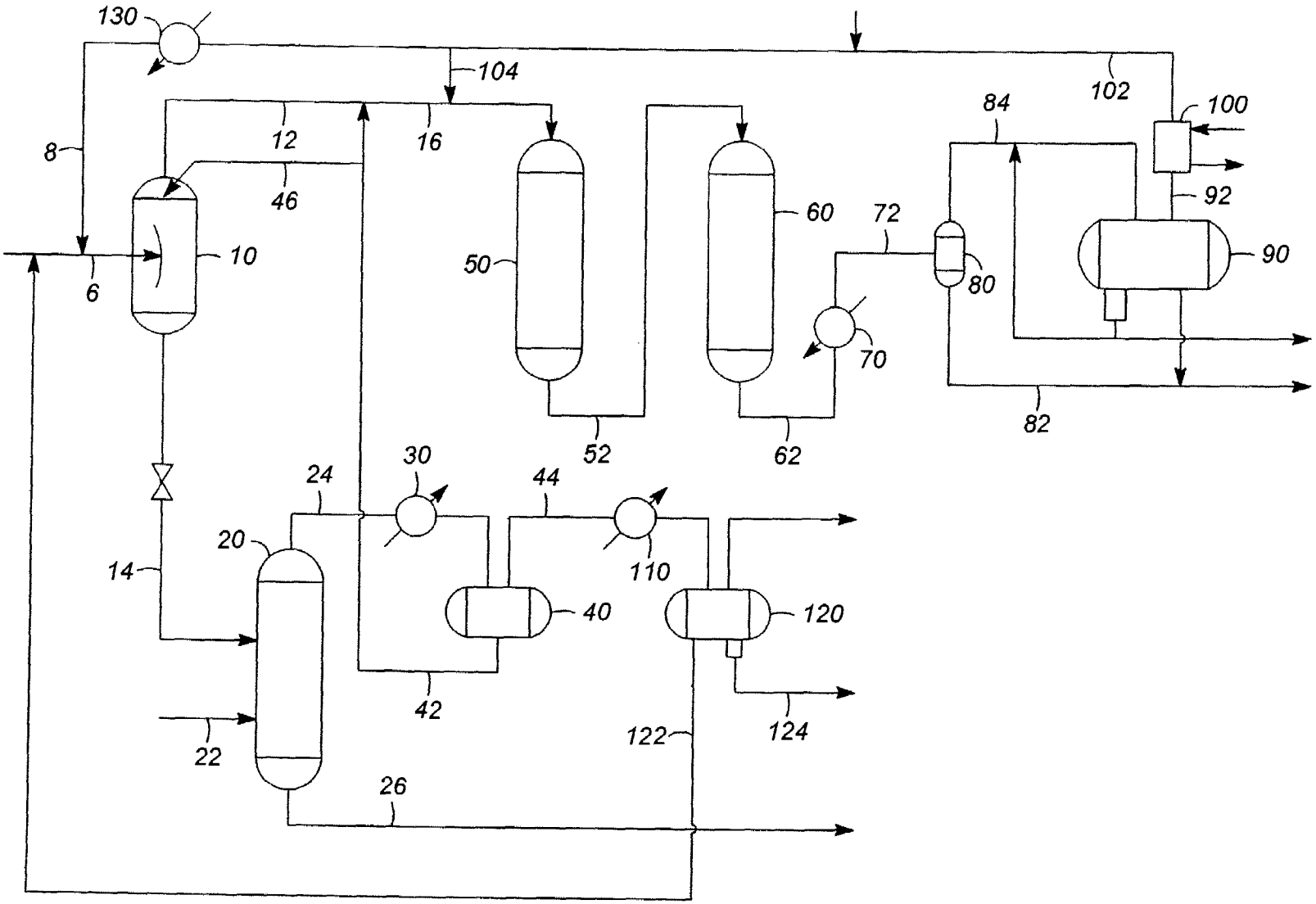
130
8
6
10
12
46
16
104
50
52
60
62
70
72
80
84
82
90
92
100
102
14
20
22
24
26
30
42
40
44
110
120
122
124

PROCESS FOR UPGRADING CONTAMINATED HYDROCARBONS

FIELD OF THE INVENTION

This invention relates to an improved process for the recovery and conversion of contaminated hydrocarbons, including oil derived from a carbonaceous waste, to produce a hydrogenated fuel or lubricating oil.

BACKGROUND OF THE INVENTION

Renewable sources of hydrocarbons are increasing in importance. With renewable resources, the dependence on imported oil for petroleum based products is reduced and a substitute for imported oil is provided. Equally important, is the recycling and reprocessing of used petroleum based products, such as waste lubricating oils, or oil derived from carbonaceous waste. There is a tremendous amount of oil that is discarded each year, and reprocessing, or rerefining, can recover a substantial amount of product from spent lubricants and other carbonaceous waste materials. Recovery and reprocessing of contaminated hydrocarbons also reduces that amount of material that needs to be disposed of in an environmentally safe manner.

The United States produces over 2.4 billion gallons of finished lubricants each year. From the lubricants produced, the U.S. Department of Energy estimates over 1.4 billion gallons of spent lubricating oils are generated. From the spent oils, either low grade fuels and re-refined base oils can be produced. There is an increasing demand for reducing waste, and recycling of waste products, and there is an increased demand for technology to address this issue. This includes the development of technology to process and recover usable lubricants, solvents, and energy related products from alternate sources of materials for hydrocarbon based products.

To meet demands of the lubricants market, the petroleum industry has made greater use of high severity hydroprocessing. Improvements are needed to produce highly saturated, hetero-atom free oils that can be used as either finished or intermediate products, such as lube oil blending stocks, petrochemical feedstocks, specialty oils and liquid transportation fuels. Also, technology that is used for re-refining waste lubricating oils often needs improvements to adapt to changing feedstocks that include non-traditional sources of hydrocarbons.

Improvements can reduce the amount of undesirable byproducts requiring treatment, increase the amount of hydrocarbons recovered for processing, and improve the quality of the recovered products.

SUMMARY OF THE INVENTION

The present invention is a process for recovering hydrocarbons from contaminated hydrocarbons for commercial usage as lubricants, solvents, and fuels. Contaminated hydrocarbons comprise a non-distillable component, such as high molecular weight tars, metals, and solids, that are detrimental to the use of these oils as lubricants. Hydroprocessing of the oil, or hydrocarbons, while leaving behind the solids enables conversion reuse of the oils as a high quality product. The contaminated hydrocarbons are separated by contacting the hydrocarbons with a stream of hot hydrogen gas to vaporize at least a portion of the hydrocarbon components in the contaminated hydrocarbons in a flash separator. The flashed vapor is drawn off and the remaining hot liquid is passed to a stripping unit, where super-heated steam is used to strip out additional hydrocarbons from the liquid into a second vapor stream. The second vapor stream is cooled to condense the hydrocarbon portion of the vapor for recovery as a liquid in a hot separator, and leaving a vapor comprising principally steam. The recovered liquid is mixed with the vaporized hydrocarbons and hydrogen from the flash separator and is passed to a hydrodemetallization reactor for removal of residual metals carried over from the flash stripper, and for removal of other compounds deleterious to downstream catalysts. The hydrodemetallization reactor creates a lower metal contents stream which is passed to a hydroprocessing reactor for hydroprocessing of the stream, resulting in an effluent stream comprising hydrocarbons useful for lubricants. A portion of the effluent stream is condensed to separate hydrogen and acid gases from the hydrocarbon liquids that have been condensed.

Other objects, advantages and applications of the present invention will become apparent to those skilled in the art from the following drawings and detailed description.

BRIEF DESCRIPTION OF THE DRAWING

FIGURE provides a schematic for an improved contaminated hydrocarbon re-refining.

DETAILED DESCRIPTION OF THE INVENTION

The present invention provides an improvement on an integrated process for the hydroconversion of contaminated hydrocarbons. As used hereinafter, the term contaminated hydrocarbons refers to, but is not be limited to, any carbonaceous waste stream, petroleum product or source, whether natural or man-made, or any liquid oil derived from biomass, such as pyrolysis oil, that contains non-distillable components that are adverse to catalysts and equipment used in processing the hydrocarbons. The non-distillable components typically are solids, such as metals and tars found in used lubricating oil, silica found in tar-sands, or other contaminants found in carbonaceous waste materials. There is a wide variety of re-cycleable contaminated lubricating oils that include hydraulic fluids, heat transfer fluids, engine lubricants, and cutting oils. Pyrolysis oil refers to oils derived from the rapid heating of materials under an oxygen lean environment where the organic material breaks down to form a liquid. This includes pyrolysis or chemical depolymerization of biomass, such as the lignin fraction of sawdust and the like, and also the heating and depolymerization of waste plastics that are synthetic polymers. These plastics are often characterized by high paraffinic content, such as polyethylene, polypropylene, and polystyrene, made from olefin monomers. The depolymerized oils also contain solids, such as additive metals and finely divided particulate matter, that prevent feeding the oils directly to a fixed bed reactor.

This invention is not intended to be limited to used and recycled oils, but to also include petroleum based products and byproducts such as slurry oil from FCC processes, atmospheric residuum; spent solvents and still bottoms from solvent recovery operations; used dielectric fluids; hydrocarbons contaminated with chlorinated biphenyls; coal tars; halogenated wastes; unconventional crudes that are contaminated with high amounts of non-distillable solids, such as Canadian oil sands, high acid number South American bitumens, and unrefined shale oils; synthetic materials, such as chlorinated byproducts from manufacture of vinyl chloride monomer and propylene oxide, waste of off-spec polymers, oils derived from depolymerizing old tires and other plastics and rubbers; as well as biologically derived oils such as black liquor from pulp and paper, tall oils, vegetable oils containing alkaline metals or salts, waste greases, tallow oils and other oils derived from animal fats.

The presence of non-distillable components and finely divided particulate matter in the feed to the process of the present invention greatly increases the difficulty in producing a high quality, reusable lubricant, solvent, or fuel from contaminated hydrocarbons or oil produced from depolymerization of carbonaceous waste materials, such as plastics or biomass. Non-distillable components tend to foul hot heat exchange surfaces which are used to heat the feed to conversion conditions, to form coke or in some other manner deactivate the catalyst thereby shortening its active life and to otherwise hinder a smooth conversion operation. Particulate matter in a feed stream tends to deposit within the catalyst reaction zones and to plug fixed catalyst beds thereby reducing processing capacity and/or abbreviating the time on stream, as well as significantly raising the processing cost.

UOP developed the HyLube™ process for re-refining used oil. The process was designed to increase on-stream efficiency to be in line with the levels found in the petroleum refining industry, while developing an environmentally friendly process. The UOP HyLube process is improved to increase the yields of re-refined oil and to reduce the water consumption and amount of waste water to be treated. However, there are still some non-distillable components that pass through to the reactors, waste water is high, and energy efficiency can be improved.

The invention, as shown in the FIGURE, comprises an improved process for the conversion of contaminated hydrocarbons to a commercial grade oil, also known as re-refining, including addressing problems of removing non-distillable components, reducing waste water, and improving energy efficiency. The contaminated hydrocarbon feed stream 6 is contacted with a hot hydrogen-rich gas stream 8 in a flash separator 10, which vaporizes a portion of the contaminated oil and generates a hot hydrocarbonaceous vapor stream 12, or first vapor stream, in the flash zone, and a heavy liquid stream 14, or first liquid stream. The hot hydrogen-rich gas stream 8 serves as a heat source used to directly heat the hydrocarbon feed stream to preclude the coke formation that could otherwise occur when using an indirect heating apparatus such as a heater or heat-exchanger, a diluent to reduce the partial pressure of the feed during vaporization in the flash zone, a possible reactant to minimize the formation of polymers at elevated temperatures, and a stripping medium and provides at least a portion of the hydrogen required in the hydrodemetallization and hydroprocessing reaction zones. The hot hydrogen rich gas 8 is maintained at a temperature higher than the oil feed stream, and is preferably at a temperature between 260° C. (500° F.) and 650° C. (1,200° F.). The hydrocarbonaceous vapor stream 12 comprises hydrogen from the hydrogen rich gas stream and hydrocarbons vaporized from the hydrocarbon feed stream. The hot contact conditions in the flash separator 10 are such that adverse reactions such as thermal degradation can take place. Therefore, it is preferable that the liquid residence time in the separator 10 is chosen to achieve the maximization of the vaporization of the hydrocarbons with the minimization of adverse thermal reactions. The residence time can vary based upon the hydrocarbon feed and the temperatures needed to vaporize the hydrocarbons from the hydrocarbon feed.

Under certain circumstance when the hydrocarbon feed stream 6 comprises a high percentage of non-distillable components, additional liquid can be utilized to wash the non-distillable components from the flash separator. A vapor wash oil of flush liquid might be an oil having a high boiling point range, such as a heavy vacuum gas oil, an atmosphere resid, or a vacuum tower bottoms stream. The selection of a flush liquid depends upon the composition of the hydrocarbon feed stream and the prevailing flash conditions in the flash separator and the volume of the flush liquid is preferably limited to that required for removal of the heavy non-distillable component.

The heavy liquid stream 14, which contains residual distillable hydrocarbons that have not been vaporized and withdrawn from the hot flash separation, is directed to a stripping column 20, without intermediate heating or cooling, where a hot gas stream 22 is used to strip the liquid 14 and generate a second vapor stream 24 comprising vaporized hydrocarbons and the diluent gas. Preferably, the flash separation minimizes the amount of distillable components in the heavy liquid stream 14 to less than 60 weight percent of the heavy liquid stream, and more preferably to less than 40 weight percent. The remaining liquid stream 26 from the stripping column 20 is a residue stream, made up of non-distillable components such as solids and other impurities, that can sold as asphalt-blending components or as a supplemental fuel in a cement kiln or steel mill, passed to storage, or routed to other units for further processing. The stripper 20 maximizes the amount of useful hydrocarbons. In a preferred operation, the stripper 20 is a vacuum stripper, and the stripping gas is super-heated steam. However, other stripping gases including hydrogen are also contemplated by this invention.

The second vapor stream 24 is a hot hydrocarbon gas stream that is condensed in a condenser 30 to liquefy the hydrocarbons recovered in the stripper and passed to a hot separator 40 where the condensed liquid is separated into a recovered oil stream 42 and the uncondensed vapor is a third vapor stream 44. In a preferred embodiment, the hot separator 40 is operated at a temperature above the dew point of the stripping gas. The recovered oil 42 is passed to be merged with the hydrocarbonaceous vapor stream 12, and the mixed stream 16 is passed to a hydrodemetallization reactor 50, where the stream contacts a hydrodemetallization catalyst at hydrodemetallization conditions, and generates a hydrodemetallization effluent stream 52. The mixed stream 16 comprises hydrogen and hydrocarbons. The hydrodemetallization reactor 50 may contain a fixed, fluidized, or ebullated catalyst bed. The recovered oil 42 aids in controlling temperatures of the hot hydrocarbonaceous vapor stream 12 by cooling the vapor stream before passing to the hydrodemetallization reactor 50.

The processing conditions of the hydrodemetallization reactor, and the catalyst used are similar to hydrotreating conditions and catalyst. The hydrodemetallization catalyst also reacts with the hot hydrocarbonaceous vapor to remove sulfur compounds, to perform some denitrification, to hydrodeoxygenate the oil and to remove some heteroatoms in addition to metals from the oil.

The hydrodemetallization effluent stream 52 is passed to a hydroprocessing reactor 60 where the effluent stream 52 is contacted with a hydroprocessing catalyst to increase the hydrogen content in the hydrocarbons. The hydroprocessing step to a greater extent reacts the hot hydrocarbonaceous vapor to remove sulfur compounds, to perform deep denitrification and hydrodeoxygenation of the hydrocarbons and to saturate aromatic compounds. The processing conditions are also at a temperature and under sufficient hydrogen partial pressure that some cracking of the larger hydrocarbon molecules will occur. The hydroprocessing reactor 60 may contain a fixed, fluidized, or ebullated catalyst bed, and is operated at hydroprocessing conditions, to produce an effluent stream 62 comprising hydroprocessed hydrocarbons. The effluent stream 62 is cooled with a cooling unit 70 to generate a liquid-vapor stream 72 which is separated in a separator 80. A liquid stream 82 is recovered comprising hydrocarbons, and a vapor stream 84 comprising hydrogen, gaseous water-soluble inorganic compounds, and lower boiling hydrocarbons. The liquid stream 82 comprises recovered liquid hydrocarbons for use as lubricating oil product stream or other commercially valuable liquids.

The vapor stream 84 is cooled and contacted with an aqueous scrubbing solution, and the resulting mixture is separated into a spent aqueous stream and a hydrogen rich vapor stream 102. The aqueous scrubbing solution is to remove acid gases in the vapor stream 84 generated in the process, and to allow recycle of the hydrogen gas. The contact with an aqueous scrubbing solution can be performed in any convenient manner, including in-line mixing which may be promoted by a mixing means. The aqueous scrubbing solution is preferably introduced in an amount from 1 to 100 volume percent based on the effluent from the hydroprocessing reactor 60. The aqueous scrubbing solution preferably comprises a basic compound such as sodium carbonate or ammonium hydroxide. The aqueous solution neutralizes and dissolves water soluble inorganic compounds.

In one embodiment, the vapor stream 84 is passed to a separator 90 for removal of some liquid carryover. The resulting vapor stream 92 is scrubbed in a scrubber 100 and the vapor is a hydrogen rich vapor stream 102. The hydrogen rich vapor stream 102 is recycled, and combined with additional hydrogen from a make-up stream to provide the hydrogen for the hot hydrogen-rich gaseous stream 8. The hydrogen rich vapor stream 102 is preferably more than 70% by volume hydrogen, and more preferably more than 85% by volume hydrogen. After combining with a make-up stream of hydrogen, the hydrogen rich vapor stream 102 is heated with a heating unit 130 and recycled to contact with the contaminated hydrocarbon stream 6 for feed to the flash separator 10.

The temperature of the hot hydrogen-rich gaseous stream 8 is sufficiently high to insure flash vaporization of at least a portion of the distillable hydrocarbons in the hydrocarbon feed stream 6. However, due to fluctuations in composition and other considerations, the temperature of the hot hydrocarbonaceous vapor stream 12 can be outside the desired operation temperatures for the catalytic hydrodemetallization reactor. While a portion of the recovered oil 42 will help bring the temperature down, the temperature might not drop sufficiently. In the event that the temperature of the mixed stream 16 of hot hydrocarbonaceous vapor and recovered oil is outside the desired temperature range, a portion 104 of the hydrogen rich vapor stream 102 can be added to the mixed stream 16 to adjust the temperature. If the temperature is too low, additional heat can be provided by the addition of hot hydrogen.

In one embodiment, a portion of the recovered oil 42 stream can be used as a flush oil for the flash feed separator 10. An aspect of the invention is routing a portion of the recovered oil 42 back to the flash feed separator 10 as a flush oil. The flush oil is sprayed into the top section of the separator vessel and is used to wash entrained solids and metals out of the vapor. An alternative to a sprayer in the top section of the separator 10 is a packed section or trays. The vapor passing through a packed or trayed section contacts the flush oil distributed over the packed or trayed section to remove entrained solids and metals from the vapor. When the hydrocarbon feed stream 6 comprises a high percentage of non-distillable components, a portion of the recovered oil stream 42 is diverted to a flush stream 46 and passed to the flash feed separator 10 as a counter current spray to wash solids out of the flash separator 10. The amount of recovered oil stream 42 passed is dependent on the amount of non-distillables in the hydrocarbon feed stream 6, but it is estimated that 10% to 15% of the recovered oil stream 42 can be used as a flush oil.

In a further improvement, the third vapor stream 44 is cooled and partially condensed in a condenser 110 and passed to a cold separator 120. In an embodiment where the vacuum stripper 20 gas is steam, the condenser 110 creates a mixture of water and residual hydrocarbons. The cold separator 120 separates the hydrocarbons as a recycle oil stream 122 and directs the recycle oil to the contaminated hydrocarbon feed 6. The cold separator 120 further separates water and water soluble materials into a condensate stream 124 that can be recycled as make-up water or first routed to a water treatment facility.

Normal flash separator contacting conditions include a temperature between 200° C. (392° F.) to 650° C. (1,200° F.), a pressure between 100 kPa (0 psig) to 14 MPa (2,000 psig), a hydrogen feed ratio between 170 normal $m^3$ $H_2/m^3$ oil (1,000 SCFB) to 16,850 normal $m^3$ $H_2/m^3$ oil (100,000 SCFB), based on the oil feed stream and an average residence time of the hydrogen containing, hydrocarbonaceous vapor stream in the flash zone from 0.1 seconds to 50 seconds, with a preferred average residence time between 1 second and 10 seconds.

Normal hydrodemetallization reaction conditions include a temperature between 150° C. (300° F.) to 450° C. (850° F.), and a pressure between 100 kPa (0 psig) to 14 MPa (2,000 psig), and preferably between 790 kPa (100 psig) to 12.5 MPa (1800 psig). Suitably, the reaction is conducted with a maximum catalyst temperature in the range selected to perform the desired hydrodemetallization conversion or to reduce undesirable components of the hydrocarbonaceous vapor stream. Within the present invention, it is contemplated that the desired demetallization includes, but is not limited to, dehalogenation, desulfurization, denitrification, olefin saturation, removal of organic phosphorous and organic silicon, and oxygenate conversion. The reaction conditions include a hydrogen to feed ratio between 33.7 normal $m^3$ $H_2/m^3$ oil (200 SCFB) to 16,850 normal $m^3$ $H_2/m^3$ oil (100,000 SCFB), based on the hydrocarbon feed stream and an average residence time of the hydrodemetallization reactor feed stream, and preferably between 50.5 normal $m^3$ $H_2/m^3$ oil (300 SCFB) to 16,850 normal $m^3$ $H_2/m^3$ oil (100,000 SCFB), and with a weighted hourly space velocity (WHSV) between 0.05 $hr^{-1}$ and 20 $hr^{-1}$.

The preferred composition of the hydrodemetallization catalyst described above is an inorganic oxide material. Porous, or non-porous catalyst materials include, but are not limited to, silica, alumina, titania, zirconia, carbon, silicon carbide, silica-alumina, diatomaceous earth, clay, and molecular sieves. Silica alumina is a material that can be amorphous or crystalline and is made up of silicon oxide structural units, but is not just a physical mixture of silica and alumina. A mixture of hydrodemetallization catalysts may be used, depending on the source of material for the hydrocarbon feed stream. A complex hydrocarbon feedstream mixture can require a mixture of catalysts due to the nature of metals and solids to be removed. In another embodiment, the catalyst includes a metal deposited on the inorganic oxide material. Suitable metals deposited on the support for hydrodemetallization activity include metals from Groups VIB and VIII of the Periodic Table. Thus the catalysts comprise one or more metals from the group of chromium (Cr), molybdenum (Mo), tungsten (W), iron (Fe), ruthenium (Ru), osmium (Os), cobalt (Co), rhodium (Rh), iridium (Ir), nickel (Ni), palladium (Pd), and platinum (Pt). The amount of active metallic component is dependent on the particular metal and the physical and chemical characteristics of the particular hydrocarbon feedstock. The metallic components selected from Group VIB are generally present in an amount between 1 and 20 weight percent of the catalyst, the iron-group metallic components of Group VIII are generally in an amount between 0.2 and 10 weight percent of the catalyst, and the noble metals of Group VIII are generally present in an amount between 0.1 and 5 weight percent of the catalyst. It is further contemplated that the hydrodemetallization catalyst may comprise one or more of the following components: cesium, francium, lithium, potassium, rubidium, sodium, copper, gold, silver, cadmium, mercury and zinc.

Normal hydroprocessing reaction conditions include a temperature between 200° C. (392° F.) to 450° C. (850° F.), and a pressure between 100 kPa (0 psig) to 14 MPa (2,000 psig). Suitably, the reaction is conducted with a catalyst temperature in the range selected to perform the desired hydrodemetallization conversion or to reduce undesirable components of the hydrocarbonaceous vapor stream. Within the present invention, it is contemplated that the desired demetallization includes, but is not limited to, dehalogenation, desulfurization, denitrification, olefin saturation, aromatic saturation and oxygenate conversion. The reaction conditions include a hydrogen to feed ratio between 33.7 normal $m^3$ $H_2/m^3$ oil (200 SCFB) to 16,850 normal $m^3$ $H_2/m^3$ oil (100,000 SCFB), based on the oil feed stream and an average residence time of the hydrodemetallization reactor feed stream, and preferably between 50.5 normal $m^3$ $H_2/m^3$ oil (300 SCFB) to 16,850 normal $m^3$ $H_2/m^3$ oil (100,000 SCFB), and with a weighted hourly space velocity (WHSV) between 0.05 $hr^{-1}$ and 20 $hr^{-1}$.

The preferred composition of a hydroprocessing catalyst disposed within the hydroprocessing reactor can generally be characterized as containing at least one metal having hydrogenation activity combined with a suitable refractory inorganic oxide carrier material of either synthetic or natural origin. The preparation of hydroprocessing catalysts is well known to those skilled in the art.

EXAMPLE

A simulation was performed using data and information available for current operations, while allowing for the addition of the new units for improving the oil water separation and improved oil recovery. The conditions and properties for the simulation were based on processing a blend of used lubricating oils as a feedstock. An oil feedstock 6 of contaminated hydrocarbons was mixed with the hot hydrogen gas stream 8 at a temperature of 485° C. in a flash separator 10. The flash separator 10 generated a flash vapor stream 12 and a flash liquid stream 14. The flash liquid stream 14 was passed to a vacuum stripper 20, where low pressure super-heated steam 22 was used to strip distillable hydrocarbons from the flash liquid stream 14. A vapor stream 24 from the vacuum stripper 20 was cooled to condense hydrocarbons in the vapor stream at a temperature above the dew point of the superheated steam. The condensed hydrocarbons created a recovered oil stream 42, and some of the recovered oil was directed to the flash separator 10 as a flush stream 46. From the flash separator 10, a first vapor stream 12 of hot hydrogen and hydrocarbons was mixed with the remaining recovered oil stream 42 from the hot separator 40 to form the reactor feed stream 16. The remaining vapor stream 44 from the hot separator 40 contained some recoverable hydrocarbons. The vapor stream 44 was condensed with a condenser 110, and the liquid was separated in a cold separator 120. From the cold separator 120, an additional hydrocarbon stream 122 of recycle oil was recovered and passed to be mixed with the feed stream for the flash separator 10.

TABLE

| | Process Simulation | | | |
|---|---|---|---|---|
| | Mass flow (kg/hr) | Temp (° C.) | Pressure (MPa) | Vapor fraction |
| Hot H2 gas (8) | 11799 | 485 | 7.1 | 1 |
| Oil feedstock (6) | 9319 | 68 | 0.2 | 0 |
| Flash vapor (12) | 17709 | 369 | 7.0 | 1 |
| Flash liquid (14) | 3810 | 372 | 7.0 | 0 |
| Steam (22) | 1001 | 380 | 0.041 | 1 |
| Recovered oil (42) | 2736 | 177 | 0.023 | 0 |
| Wash oil (46) | 400 | 177 | 7.1 | 0 |
| Reactor feed (16) | 20045 | 316 | 7.0 | 0.994 |
| Non-distillables (26) | 1394 | 334 | 0.04 | 0 |
| Recycle oil (122) | 76 | 40 | 0.2 | 0 |

The results of the simulation showed a recovery over 80% of the oil feedstock for these conditions and the hydroprocessed product had a composition consistent with high quality lubrication oils when recovered as a lubrication product stream, while improving the quality of the waste water byproduct.

While the invention has been described with what are presently considered the preferred embodiments, it is to be understood that the invention is not limited to the disclosed embodiments, but it is intended to cover various modifications and equivalent arrangements included within the scope of the appended claims.

The invention claimed is:

1. A process for the conversion of contaminated hydrocarbons comprising:

contacting the contaminated hydrocarbons with a hot hydrogen rich gas stream in a flash feed separator thereby generating a first vapor stream, and a first liquid stream;

stripping the first liquid stream in a stripping column using a stripping gas, thereby generating a second vapor stream, and a residue stream;

condense a portion of the second vapor stream to a vapor-liquid stream and separate the vapor-liquid stream, thereby creating a recovered oil stream and a third vapor stream;

contacting the first vapor stream and a portion of the recovered oil stream with a hydrodemetallization catalyst in a hydrodemetallization reactor operated at hydrodemetallization conditions, thereby generating a hydrogen-hydrocarbon stream with lower metals content;

contacting the hydrogen-hydrocarbon stream with a hydroprocessing catalyst in a hydroprocessing reactor operated at hydroprocessing conditions, thereby generating a hydrocarbon stream with a higher hydrogen content;

condensing at least a portion of the higher hydrogen content hydrocarbon stream, thereby generating a hydrogen vapor stream and a second liquid stream comprising hydrocarbons;

recovering the second liquid stream.

2. The process of claim 1 further comprising passing a portion of the recovered oil stream to contact the contaminated hydrocarbons and hot hydrogen rich gas.

3. The process of claim 1 wherein the stripping gas is steam.

4. The process of claim 1 wherein said hydrodemetallization conditions include a temperature from 150° C. (300° F.)

to 460° C. (860° F.), a pressure from 790 kPa (100 psig) to 12.5 MPa (1800 psig), a liquid hourly space velocity from 0.05 $hr^{-1}$ and 20 $hr^{-1}$ and a hydrogen to feed ratio between 33.7 normal $m^3$ $H_2/m^3$ oil (200 SCFB) to 16,850 normal $m^3$ $H_2/m^3$ oil (100,000 SCFB).

5. The process of claim 1 wherein the stripping column is a vacuum stripper.

6. The process of claim 1 wherein the second liquid stream is a lubricating oil product stream.

7. The process of claim 1 further comprising:

contacting the hydrogen vapor stream with an aqueous solution, thereby generating a hydrogen rich vapor stream and a liquid aqueous stream.

8. The process of claim 7 further comprising passing the hydrogen rich vapor stream to contact the contaminated hydrocarbons.

9. The process of claim 8 further comprising heating the hydrogen rich vapor stream prior to contact with the contaminated hydrocarbons in the flash separator, thereby generation the hot hydrogen rich gas stream.

10. The process of claim 8 further comprising contacting a portion of the hydrogen rich vapor stream with the first vapor stream prior to the hydrodemetallization reactor.

11. The process of claim 1 further comprising cooling the third vapor stream and separating into a recycle oil stream and a third liquid stream.

12. The process of claim 11 further comprising passing the recycle oil stream to mix with the contaminated hydrocarbons.

13. The process of claim 11 wherein the third liquid stream is an aqueous stream.

* * * * *